US007353762B2

(12) United States Patent
Mathis

(10) Patent No.: US 7,353,762 B2
(45) Date of Patent: Apr. 8, 2008

(54) CORDLESS STITCH REMOVING DEVICE

(76) Inventor: Peggy Mathis, 17161 Second St., St. Petersburg, FL (US) 33708

( * ) Notice: Subject to any disclaimer, the term of this patent is extended or adjusted under 35 U.S.C. 154(b) by 403 days.

(21) Appl. No.: 11/083,237

(22) Filed: Mar. 16, 2005

(65) Prior Publication Data

US 2006/0207099 A1 Sep. 21, 2006

(51) Int. Cl.
*D05B 89/00* (2006.01)
*D05B 65/00* (2006.01)

(52) U.S. Cl. ..... 112/475.17; 112/285

(58) Field of Classification Search ..... 112/285, 112/288, 292, 294, 475.17; 83/910, 930; 30/272.1, 162, 294, 277.4, 45, 38
See application file for complete search history.

(56) References Cited

U.S. PATENT DOCUMENTS 630,792 A * 8/1899 Applebay ..... 30/272.1
1,719,304 A * 7/1929 Palmer ..... 12/39.3
1,876,075 A * 9/1932 Reichert, Jr. et al. ..... 30/240
2,470,287 A * 5/1949 Carter ..... 30/122
2,701,911 A * 2/1955 Maescher ..... 30/240
2,710,448 A * 6/1955 Andrews ..... 30/162
3,454,973 A * 7/1969 Maloney ..... 12/103
4,891,884 A * 1/1990 Torbet ..... 30/277.4
5,054,199 A * 10/1991 Ogawa et al. ..... 30/34.1
6,240,645 B1 * 6/2001 Ozeki ..... 30/294
7,028,405 B2 * 4/2006 Paas et al. ..... 30/45

* cited by examiner

*Primary Examiner*—Ismael Izaguirre

(57) ABSTRACT

The present invention provides a cordless device for removing a single layer of stitches from a fabric. The cordless device comprising a body having a top end and a bottom end. At the top end of the body is a blade having a plurality of upper teeth and a plurality of lower teeth for cutting the layer of stitches to be removed from the fabric. Inside of the body is a high powered motor for actuating the blade in a back and forth motion across the layer of stitches being cut. A cordless power source, such as a battery, is positioned inside the body to provide power to the motor.

2 Claims, 4 Drawing Sheets

CORDLESS STITCH REMOVING DEVICE

FIELD OF THE INVENTION

This invention relates to a device for removing stitches. More specifically, this invention relates to a cordless device for removing stitches one layer at a time from a fabric.

BACKGROUND OF THE INVENTION

Manual stitch removers, such as seam rippers, have been used for many years. The manual (hand-powered) seam ripper is designed with cutting surfaces on the inner surface of its long tines to remove needlepoint and crewel-embroidery stitches. Once the desired layer of stitches is cut, the operator then removes the cut layer of stitches from the fabric. The drawback of the manually operated seam ripper is its slowness in operation and the amount of exerted energy by the operator in cutting the stitches from the fabric.

An improvement over the manual seam ripper is the motorized stitch remover which has also been in use for many years. The blades of the motorized stitch remover are actuated by the motor which allows the user to easily move the blades across the stitches and thereby cut the stitches to be removed. These motorized stitch removers provide speed and ease of operation over the manually operated seam ripper.

However, the motorized stitch remover is not able to consistently cut one layer of stitches at a time like the manually operated seam ripper. Also, many times, the stitches being removed from the fabric by the motorized stitch remover are pulverized into powder causing the debris to be trapped in the underlying fabric. This pulverized powder cannot be removed from the fabric.

Another weakness of the prior art motorized stitch remover is in regard to the internal shaft connection between the motor and the blade. Specifically, a soft material, such as plastic, is used for the shaft which does not adequately absorb the fluctuations in inertia force from cutting stitches of different densities. These fluctuations in inertia force cause damage or even worst, the motor of the motorized stitch remover to burn out.

Moreover, the use of prior art motorized stitch remover requires a corded power source which limits the use of the motorized stitch remover to locations having a power receptacle.

Therefore, there is a need for an improved motorized stitch remover that is cordless and is capable of cutting one layer of stitches at a time without creating debris that is trapped in the underlying fabric.

Nothing in the prior art provides the benefits attendant with the present invention.

Therefore, it is an object of the present invention to provide an improvement which overcomes the inadequacies of the prior art devices and which is a significant contribution to the advancement of the stitch removal art.

Another object of the present invention is to provide a device for removing stitches, comprising a body having a top end and a bottom end; a blade positioned at said top end of said body; a motor positioned within said body, said motor in communication with said blade; and a cordless power source positioned within said body, said cordless power source connected to said motor.

Yet another object of the present invention is to provide a device for removing stitches, comprising a body having a top end and a bottom end; a blade positioned at said top end of said body, said blade having a plurality of upper teeth and a plurality of lower teeth; a motor positioned within said body, said motor in communication with said blade; and a cordless power source positioned within said body, said cordless power source connected to said motor.

Still yet another object of the present invention is to provide a method for removing stitches from a fabric, said method comprising the steps of providing the fabric needing a layer of stitches removed; providing a stitch removing device comprising a body having a top end and a bottom end, a blade positioned at said top end of said body, a motor positioned within said body, said motor in communication with said blade, and a cordless power source positioned within said body, said cordless power source connected to said motor; pushing said blade of the stitch removing device back and forth across the layer of stitches in the fabric, thereby grabbing and cutting the layer of stitches while the device is moving back and forth; turning the fabric over; and pulling out the cut layer of stitches.

Another object of the present invention is to provide a method for removing stitches from a fabric, said method comprising the steps of providing the fabric needing a layer of stitches removed; providing a stitch removing device comprising a body having a top end and a bottom end, a blade positioned at said top end of said body, said blade having a plurality of upper teeth and a plurality of lower teeth, a motor positioned within said body, said motor in communication with said blade, and a cordless power source positioned within said body, said cordless power source connected to said motor; pushing said plurality of upper teeth and said plurality of lower teeth of said blade of the stitch removing device back and forth across the layer of stitches in the fabric, thereby grabbing and cutting the layer of stitches while the device is moving back and forth; turning the fabric over; and pulling out the cut layer of stitches.

The foregoing has outlined some of the pertinent objects of the present invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a cordless device for removing a layer of stitches from a fabric or any other item having stitches.

A feature of the present invention is to provide a device for removing stitches, comprising a body having a top end and a bottom end. At the top end of the body is a blade for cutting the stitches to be removed from the fabric. Inside of the body is a high powered motor for actuating the blade in a back and forth motion across the layer of stitches being cut. Also provided inside the body is a brass shaft having a first end and a second end. The first end of the brass shaft is connected to the high powered motor and the second end of the brass shaft is connected to the blade. A cordless power source, such as a battery, is positioned inside the body to provide power to the motor.

Another feature of the present invention is to provide a device for removing stitches comprising a body having a top end and a bottom end. At the top end of the body is a blade having a plurality of upper teeth and a plurality of lower teeth for cutting the stitches to be removed from the fabric. Inside of the body is a high powered motor for actuating the blade in a back and forth motion across the layer of stitches being cut. Also provided inside the body is a brass shaft having a first end and a second end. The first end of the brass shaft is connected to the high powered motor and the second end of the brass shaft is connected to the blade. A cordless power source, such as a battery, is positioned inside the body to provide power to the motor.

Yet another feature of the present invention is to provide a method for removing a single layer of stitches from a fabric. The method comprising the steps of providing the fabric that needs a layer of stitches removed. Providing a stitch removing device comprising a body having a top end and a bottom end. At the top end of the body is a blade for cutting the layer of stitches to be removed from the fabric. Inside of the body is a high powered motor for actuating the blade in a back and forth motion across the layer of stitches being cut. Also provided inside the body is a brass shaft having a first end and a second end. The first end of the brass shaft is connected to the high powered motor and the second end of the brass shaft is connected to the blade. A cordless power source, such as a battery, is positioned inside the body to provide power to the motor. The blade of the device is pushed back and forth across the layer of stitches to be removed from the fabric, thereby grabbing and cutting the layer of stitches while the device is moving back and forth. The fabric is then turned over so that the layer of stitches that have been cut can be pulled out.

Still yet another feature of the present invention is to provide a method for removing a single layer of stitches from a fabric. The method comprising the steps of providing the fabric that needs a layer of stitches removed. Providing a stitch removing device comprising a body having a top end and a bottom end. At the top end of the body is a blade having a plurality of upper teeth and a plurality of lower teeth for cutting the layer of stitches to be removed from the fabric. Inside of the body is a high powered motor for actuating the blade in a back and forth motion across the layer of stitches being cut. Also provided inside the body is a brass shaft having a first end and a second end. The first end of the brass shaft is connected to the high powered motor and the second end of the brass shaft is connected to the blade. A cordless power source, such as a battery, is positioned inside the body to provide power to the motor. The plurality of upper teeth and plurality of lower teeth of the blade of the device are pushed back and forth across the layer of stitches to be removed from the fabric, thereby grabbing and cutting the layer of stitches while the device is moving back and forth. The fabric is then turned over so that the layer of stitches that have been cut can be pulled out.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

A cordless device for removing one layer of stitches at a time from a fabric is disclosed. This cordless device allows a user to effortlessly remove one layer of stitches at a time from a fabric without having the debris from the cut layer of stitches becoming trapped in the fabric.

Figure 1:
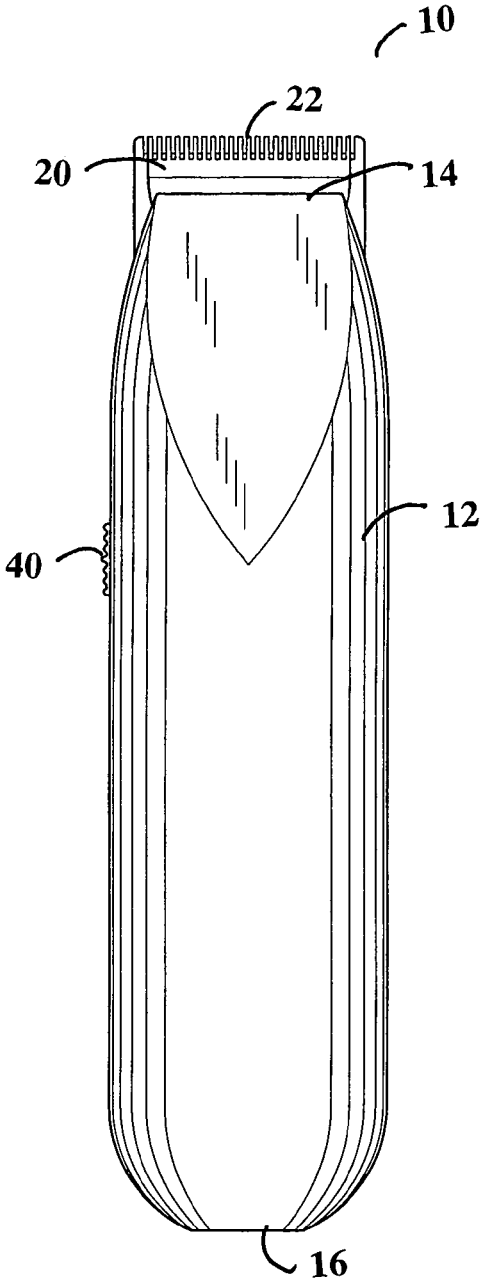
FIG. 1 is a front perspective view of a cordless device for removing stitches one layer at a time from a fabric.

Referring in detail to the drawings in which like numbers refer to the same features. FIG. 1 is a front perspective view of a cordless device 10 for removing stitches one layer at a time from a fabric. As shown in FIG. 1, the cordless device 10 comprising a body 12 having a top end 14 and a bottom end 16. At the top end 14 of the body 12 is a blade 20 having a plurality of teeth 22 for cutting the stitches to be removed from the fabric. An on/off switch 40 is provided.

The materials for the body 12 are traditional, e.g., wood, thermosetting or thermoplastic polymers (preferred), aluminum, etc. The body 12 may be rectangular, hexagonal, octagonal, oval, round, ergo dynamic (preferred), etc.

Figure 2:
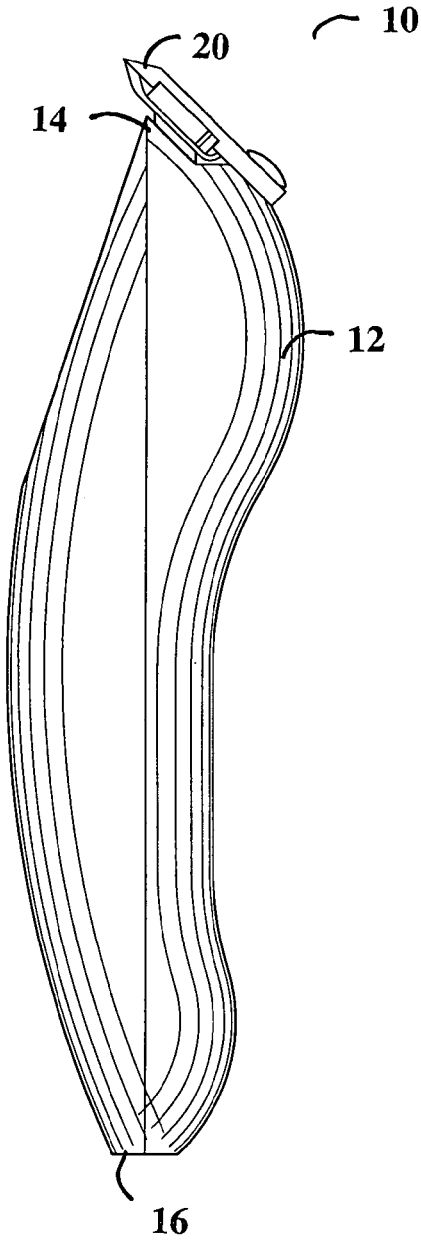
FIG. 2 is a right perspective view of a cordless device for removing stitches one layer at a time from a fabric.

Referring to FIG. 2 which is a right perspective view of a cordless device 10 for removing stitches one layer at a time from a fabric. As shown in FIG. 2, the cordless device 10 comprising a body 12 having a top end 14 and a bottom end 16. At the top end 14 of the body 12 is a blade 20 for cutting the stitches to be removed from the fabric.

Figure 3:
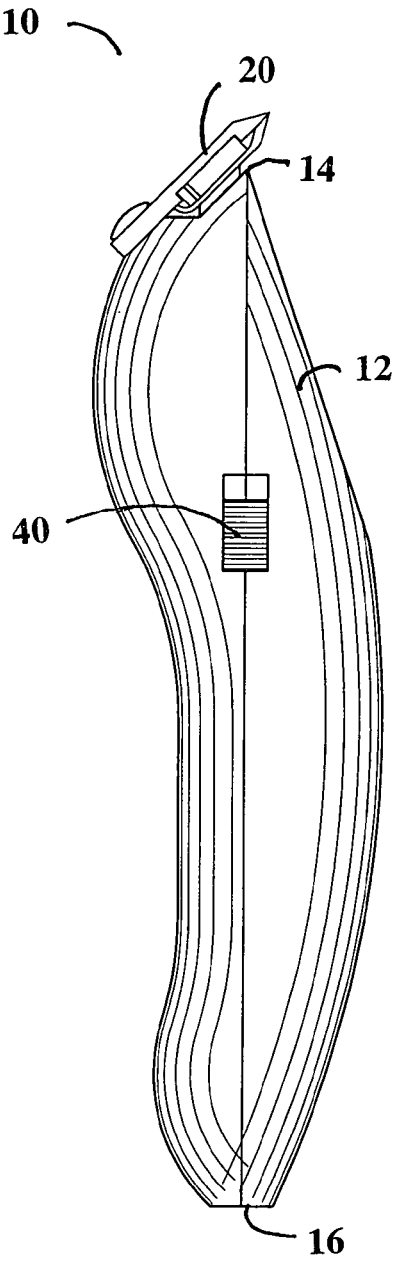
FIG. 3 is a left perspective view of a cordless device for removing stitches one layer at a time from a fabric.

Referring to FIG. 3 which is a left perspective view of a cordless device 10 for removing stitches one layer at a time from a fabric. As shown in FIG. 3, the cordless device 10 comprising a body 12 having a top end 14 and a bottom end 16. At the top end 14 of the body 12 is a blade 20 for cutting the stitches to be removed from the fabric. An on/off switch 40 is provided.

Figure 4:
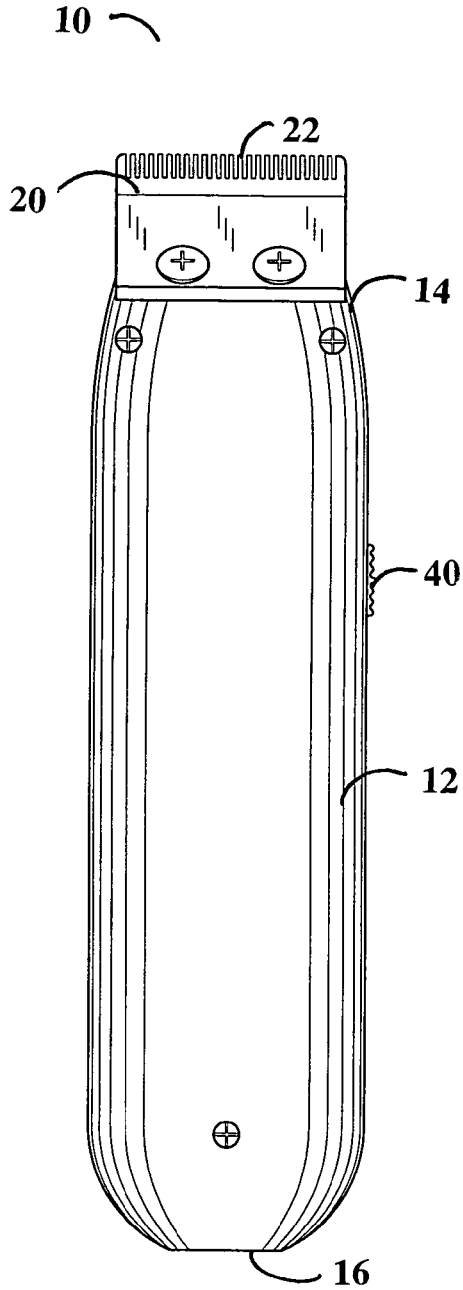
FIG. 4 is a rear perspective view of a cordless device for removing stitches one layer at a time from a fabric.

Referring to FIG. 4 which is a rear perspective view of a cordless device 10 for removing stitches one layer at a time from a fabric. As shown in FIG. 4, the cordless device 10 comprising a body 12 having a top end 14 and a bottom end 16. At the top end 14 of the body 12 is a blade 20 having a plurality of teeth 22 for cutting the stitches to be removed from the fabric. An on/off switch 40 is provided.

Figure 5:
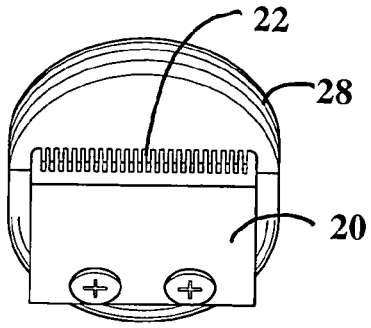
FIG. 5 is a top perspective view of a blade unit for a cordless device for removing stitches one layer at a time from a fabric.
Figure 6:
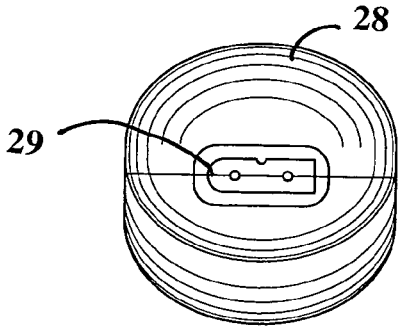
FIG. 6 is bottom perspective view of a blade unit for a cordless device for removing stitches one layer at a time from a fabric.

Referring to FIG. 5 which is a top perspective view of a blade unit 28 for a cordless device 10 for removing stitches one layer at a time from a fabric. As shown in FIG. 5, the blade unit 28 comprising a blade 20 having a plurality of teeth 22 for cutting the stitches to be removed from the fabric. FIG. 6 is a bottom perspective view of the blade unit 28 showing the connector 29 for attaching the blade unit 28 to the body 12.

Figure 7:
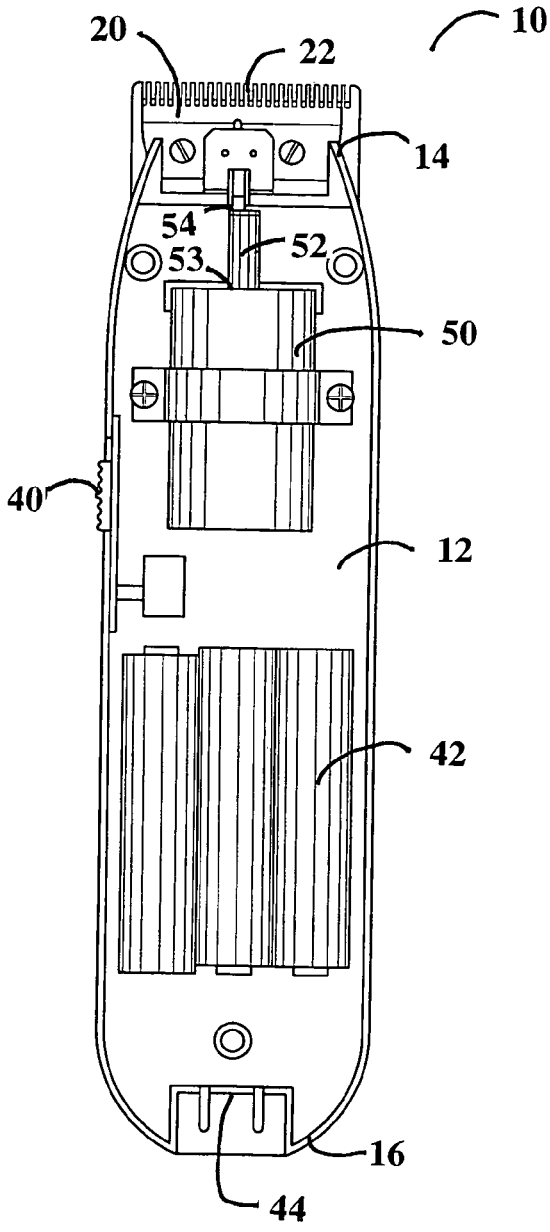
FIG. 7 is an internal perspective view of a cordless device for removing stitches one layer at a time from a fabric.

Referring to FIG. 7 which is an internal perspective view of a cordless device 10 for removing stitches one layer at a time from a fabric. As shown in FIG. 7, the cordless device 10 comprising a body 12 having a top end 14 and a bottom end 16. At the top end 14 of the body 12 is a blade 20 having a plurality of teeth 22 for cutting the stitches to be removed from the fabric. An on/off switch 40 is provided. Inside of the body 12 is a high powered motor 50 for actuating the blade 20 in a back and forth motion across the layer of stitches being cut. Also provided inside the body 12 is a heavy duty shaft 52 having a first end 53 and a second end 54. The first end 53 of the shaft 52 is connected to the high powered motor 50 and the second end 54 of the shaft 52 is connected to the blade 20. A cordless power source, such as a battery 42, is positioned inside the body 12 to provide power to the motor 50. The device 10 of the present invention can be powered by the internal battery 42 or by a cord (not shown) from an external power supply (not shown) that plugs into receptacle 44 at the bottom end 16 of the body 12. In a preferred embodiment, the battery 42 is of a rechargeable type such as nickel cadmium or nickel metal hydride, etc.

In a preferred embodiment, the shaft 52 is made of a metallic material, e.g., brass or other hard materials. In a preferred embodiment the shaft 52 has a diameter of about 6 millimeters. The brass shaft 52 of the present invention overcomes the inadequacy of the prior art of using a soft material, e.g., plastic for the shaft. The importance of using a hard material for the shaft 52 is to absorb the inertia force that results from cutting stitches of varying thicknesses and density. Sometimes the energy build up in resistance damages or completely burns out the motor 50. The brass shaft 52 of the present invention is able to withstand the resistance and thereby ensure the longevity of the motor.

Figure 9:
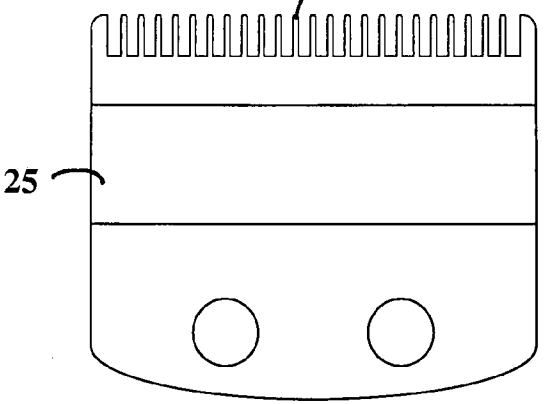
FIG. 9 is a top perspective view of the back of the upper blade for a cordless device for removing stitches one layer at a time from a fabric.
Figure 10:
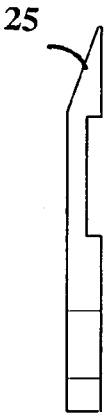
FIG. 10 is a side perspective view of the upper blade for a cordless device for removing stitches one layer at a time from a fabric.
Figure 8:
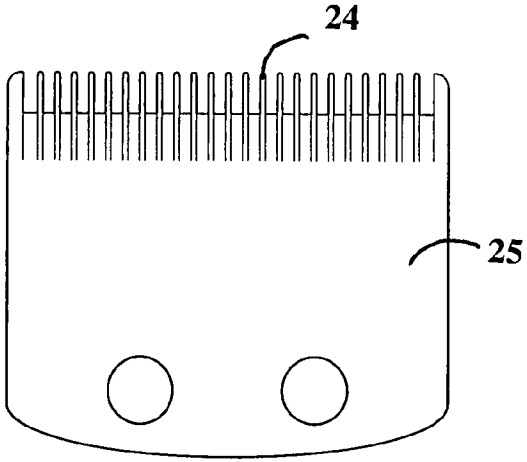
FIG. 8 is a top perspective view of the front of the upper blade for a cordless device for removing stitches one layer at a time from a fabric.

Referring to FIG. 8 which is a top perspective view of the front of the upper blade 25 showing the plurality of upper teeth 24. FIG. 9 is a top perspective view of the back of the upper blade 25 showing the plurality of upper teeth 24 and FIG. 10 is a side perspective view of the upper blade 25.

Figure 12:
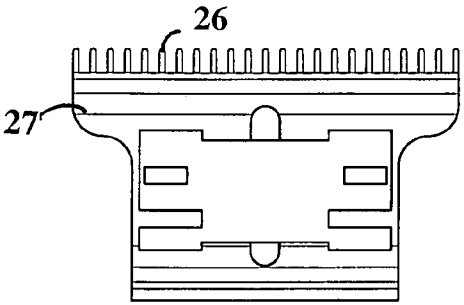
FIG. 12 is a top perspective view of the back of the lower blade for a cordless device for removing stitches one layer at a time from a fabric.
Figure 13:
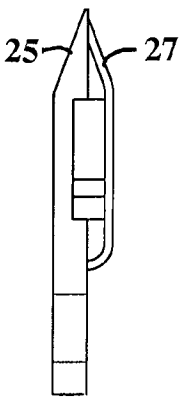
FIG. 13 is a side perspective view of the lower blade attached to the upper blade for a cordless device for removing stitches one layer at a time from a fabric.
Figure 11:
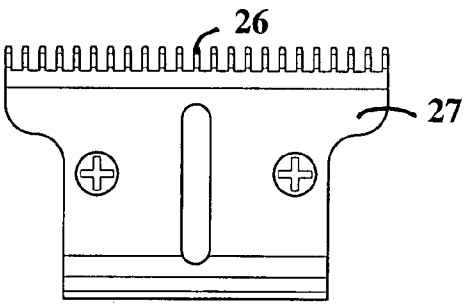
FIG. 11 is a top perspective view of the front of the lower blade for a cordless device for removing stitches one layer at a time from a fabric.

Referring to FIG. 11 which is a top perspective view of the front of the lower blade 27 showing the plurality of lower teeth 26. FIG. 12 is a top perspective view of the back of the lower blade 27 showing the plurality of lower teeth 26. FIG. 13 is a side perspective view of the lower blade 27 attached to the upper blade 26. In a preferred embodiment, the plurality of upper teeth 24 of the upper blade 25 are flush to the plurality of lower teeth 26 of the lower blade 27.

In a preferred embodiment, the plurality of upper teeth 24 of the upper blade 25 and the plurality of lower teeth 26 of the lower blade 27 are microscopically scored with scratches at the top of the respective teeth 24, 26. These microscopic scratches help to grab the layer of stitches that are being cut by the cordless device 10 of the present invention. In a preferred embodiment, the plurality of lower teeth 26 of the lower blade 27 have a depth of about 1.9 millimeters to help ensure that only one layer of stitches is cut at a time by the cordless device 10 of the present invention.

In addition, a method for removing a single layer of stitches from a fabric using a cordless stitch remover of the present invention is also disclosed. The method comprising the steps of providing the fabric that needs a layer of stitches removed. Providing a stitch removing device 10 comprising a body 12 having a top end 14 and a bottom end 16. At the top end 14 of the body 12 is an upper blade 25 blade having a plurality of upper teeth 24 and a lower blade 27 having a plurality of lower teeth 26 for cutting the layer of stitches to be removed from the fabric. Inside of the body 12 is a high powered motor 50 for actuating the upper blade 25 and lower blade 27 in a back and forth motion across the layer of stitches being cut. Also provided inside the body 12 is a brass shaft 52 having a first end 53 and a second end 54. The first end 53 of the brass shaft 52 is connected to the high powered motor 50 and the second end 54 of the brass shaft 52 is connected to the upper blade 25 and lower blade 27. A cordless power source, such as a battery 42, is positioned inside the body 12 to provide power to the motor 50. The plurality of upper teeth 24 of the upper blade 25 and plurality of lower teeth 26 of the lower blade 27 of the device 10 are pushed back and forth across the layer of stitches to be removed from the fabric, thereby grabbing and cutting the layer of stitches while the device 10 is moving back and forth. The fabric is then turned over so that the layer of stitches that have been cut can be pulled out.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A device for removing stitches, comprising:

a body having a top end and a bottom end;

a blade positioned at said top end of said body, said blade having a plurality of upper teeth and a plurality of lower teeth; said plurality of upper teeth and said plurality of lower teeth are microscopically scored with scratches at the top of teeth;

a motor positioned within said body, said motor in communication with said blade; and a cordless power source positioned within said body, said cordless power source connected to said motor.

2. A method for removing stitches from a fabric, said method comprising:

providing the fabric needing a layer of stitches removed;

providing a stitch removing device comprising a body having a top end and a bottom end, a blade positioned at said top end of said body, said blade having a said plurality of lower teeth of said stitch removing device are microscopically scored with scratches at the top of teeth, a motor positioned within said body, said motor in communication with said blade and a cordless power source positioned within said body, said cordless power source connected to said motor;

pushing said plurality of upper teeth and said plurality of lower teeth of said blade of the stitch removing device back and forth across the layer of stitches in the fabric, thereby grabbing and cutting the layer of stitches while the device is moving back and forth:

turning the fabric over; and pulling out the cut layer of stitches.

* * * * *

UNITED STATES PATENT AND TRADEMARK OFFICE

CERTIFICATE OF CORRECTION

PATENT NO. : 7,353,762 B2
APPLICATION NO. : 11/083237
DATED : April 8, 2008
INVENTOR(S) : Peggy Mathis It is certified that error appears in the above-identified patent and that said Letters Patent is hereby corrected as shown below:

Claim 2 should read:

A method for removing stitches from a fabric, said method comprising:

providing the fabric needing a layer of stitches removed;

providing a stitch removing device comprising a body having a top end and a bottom end, a blade positioned at said top end of said body, said blade having a said <u>plurality of upper teeth and a plurality of lower teeth, said plurality of upper teeth and</u> said plurality of lower teeth of said stitch removing device are microscopically scored with scratches at the top of teeth, a motor positioned within said body, said motor in communication with said blade and a cordless power source positioned within said body, said cordless power source connected to said motor;

pushing said plurality of upper teeth and said plurality of lower teeth of said blade of the stitch removing device back and forth across the layer of stitches in the fabric, thereby grabbing and cutting the layer of stitches while the device is moving back and forth;

UNITED STATES PATENT AND TRADEMARK OFFICE

CERTIFICATE OF CORRECTION

PATENT NO. : 7,353,762 B2
APPLICATION NO. : 11/083237
DATED : April 8, 2008
INVENTOR(S) : Peggy Mathis It is certified that error appears in the above-identified patent and that said Letters Patent is hereby corrected as shown below:

turning the fabric over; and pulling out the cut layer of stitches.

Signed and Sealed this

Twenty-first Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,353,762 B2
APPLICATION NO. : 11/083237
DATED : April 8, 2008
INVENTOR(S) : Peggy Mathis It is certified that error appears in the above-identified patent and that said Letters Patent is hereby corrected as shown below:

Column 6, line 59 thru Column 8, line 4,

Claim 2 should read:

A method for removing stitches from a fabric, said method comprising:

providing the fabric needing a layer of stitches removed;

providing a stitch removing device comprising a body having a top end and a bottom end, a blade positioned at said top end of said body, said blade having a said <u>plurality of upper teeth and a plurality of lower teeth, said plurality of upper teeth and</u> said plurality of lower teeth of said stitch removing device are microscopically scored with scratches at the top of teeth, a motor positioned within said body, said motor in communication with said blade and a cordless power source positioned within said body, said cordless power source connected to said motor;

pushing said plurality of upper teeth and said plurality of lower teeth of said blade of the stitch removing device back and forth across the layer of stitches in the fabric, thereby grabbing and cutting the layer of stitches while the device is moving back and forth;

UNITED STATES PATENT AND TRADEMARK OFFICE

CERTIFICATE OF CORRECTION

PATENT NO. : 7,353,762 B2
APPLICATION NO. : 11/083237
DATED : April 8, 2008
INVENTOR(S) : Peggy Mathis It is certified that error appears in the above-identified patent and that said Letters Patent is hereby corrected as shown below:

turning the fabric over; and pulling out the cut layer of stitches.

This certificate supersedes the Certificate of Correction issued October 21, 2008.

Signed and Sealed this

Eleventh Day of November, 2008

JON W. DUDAS
*Director of the United States Patent and Trademark Office*